US010141684B2

(12) United States Patent
Itzler et al.

(10) Patent No.: US 10,141,684 B2
(45) Date of Patent: Nov. 27, 2018

(54) STRAIN RELIEF CONNECTOR ASSEMBLIES FOR ELECTRICAL WIRING

(71) Applicant: HUBBELL INCORPORATED, Shelton, CT (US)

(72) Inventors: Roy J. Itzler, Orange, CT (US); Michael K. Williams, Watertown, CT (US); Michael J. Zbriger, Oxford, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/453,140

(22) Filed: Mar. 8, 2017

(65) Prior Publication Data

US 2017/0264043 A1 Sep. 14, 2017

Related U.S. Application Data

(60) Provisional application No. 62/304,996, filed on Mar. 8, 2016.

(51) Int. Cl.

| | |
|---|---|
| ***H01R 13/58*** | (2006.01) |
| ***H01R 13/59*** | (2006.01) |
| ***H01R 31/06*** | (2006.01) |
| ***H01R 13/52*** | (2006.01) |

(52) U.S. Cl.

CPC ..... *H01R 13/582* (2013.01); *H01R 13/5205* (2013.01); *H01R 13/5825* (2013.01); *H01R 13/59* (2013.01); *H01R 31/06* (2013.01)

(58) Field of Classification Search

CPC ..... H01R 24/64; H01R 13/6658; H01R 2107/00; H01R 13/5205; H01R 13/6581; H01R 24/60; H01R 13/5202; H01R 13/5213; H01R 13/639; H01R 13/6461; H01R 13/6593; H01R 13/506; H01R 13/5221; H01R 13/5825

See application file for complete search history.

(56) References Cited

U.S. PATENT DOCUMENTS

| | | | | |
|---|---|---|---|---|
| 3,009,129 A | | 11/1961 | Kirk, Jr. | |
| 3,448,430 A | | 6/1969 | Kelly | |
| 4,273,405 A | * | 6/1981 | Law | H01R 13/648 174/652 |
| 5,170,017 A | | 12/1992 | Stainevich | |
| 5,178,559 A | | 1/1993 | Mello | |

(Continued)

FOREIGN PATENT DOCUMENTS

| | | |
|---|---|---|
| EP | 0254083 A2 | 1/1988 |

OTHER PUBLICATIONS

International Search Report dated May 22, 2017 from corresponding International Patent Application PCT/US2017/021305, 3 pages.

(Continued)

*Primary Examiner* — Truc Nguyen

(74) *Attorney, Agent, or Firm* — Ohlandt, Greeley, Ruggiero and Perle, LLP

(57) ABSTRACT

A strain relief connector assembly for flexible electrical wiring is provided that includes an adapter that is configured to form a sealed connection to the wiring and a connector and to form a connection with a strain relieving device, which can include an arc of bend control mesh.

15 Claims, 6 Drawing Sheets

(56) References Cited

U.S. PATENT DOCUMENTS 5,310,359 A * 5/1994 Chadbourne ..... H01R 13/59 439/462
5,567,174 A * 10/1996 Ericson, Jr. ..... H01R 13/5205 439/462
2002/0123263 A1* 9/2002 Lazaro, Jr. ..... H01R 13/424 439/459
2003/0139087 A1* 7/2003 Sprunger ..... H01R 9/032 439/449
2009/0111319 A1 4/2009 Baldwin et al.
2009/0111321 A1* 4/2009 Baldwin ..... H01R 13/5829 439/471
2009/0191750 A1* 7/2009 Kadar-Kallen ..... H01R 13/502 439/578
2011/0230083 A1* 9/2011 Anderson ..... H01R 13/5213 439/521
2014/0256166 A1* 9/2014 Ramos ..... H01R 13/5221 439/271
2015/0318637 A1* 11/2015 Griepenstroh ..... H01R 13/5025 439/471
2015/0340806 A1* 11/2015 Ilkhanov ..... H01R 13/6215 439/278
2015/0364854 A1* 12/2015 Lindkamp ..... H01R 13/512 439/738
2016/0018603 A1* 1/2016 Mooij ..... G02B 6/3817 385/76
2016/0365669 A1* 12/2016 Taylor ..... H01R 13/5841

OTHER PUBLICATIONS

Written Opinion dated May 22, 2017 from corresponding International Patent Application PCT/US2017/021305, 4 pages.

* cited by examiner

STRAIN RELIEF CONNECTOR ASSEMBLIES FOR ELECTRICAL WIRING

CROSS REFERENCE TO RELATED APPLICATIONS

This application claims the benefit to U.S. Provisional Application No. 62/304,996 filed on Mar. 8, 2016, the entire contents of which are incorporated herein by reference.

BACKGROUND

1. Field of the Invention

The present disclosure is related to electrical wiring. More particularly, the present disclosure is related to strain relief connector assemblies for electrical wiring.

2. Description of Related Art

The use of utilities in commercial, industrial, and residential settings are ubiquitous. The utilities can include, but are not limited to, electrical power, pressurized fluids, communications signal, and others, where these utilities can be supplied via conduits—rigid, flexible, and combinations thereof. In instances of the supply of electrical power, the use of flexible electrical wiring can present various connection challenges.

One such connection challenge is the ability to provide a sealed connection with the flexible electrical wiring. Another connection challenge is the need to provide a strain relief function to the flexible electrical wiring at the sealed connection.

Advantageously, the present disclosure provides strain relief connector assemblies for flexible electrical wiring that have expanded connect ability to overcome, alleviate, and/or mitigate one or more deleterious effects of prior art assemblies.

SUMMARY

A strain relief connector assembly for flexible electrical wiring is provided that includes an adapter that is configured to form a sealed connection to the wiring and a connector and to form a strain relieving connection with the wiring. The strain relief connector assembly can, in some embodiments, further include an arc of bend control function. The flexible electrical wiring can include flexible electric cords or flexible conduits. In embodiments where the electrical wiring is flexible conduit, the flexible conduit can metallic or non-metallic.

In some embodiments, the connector can be selected from the group consisting of a male or female straight blade connector, a male or female twist lock connector, a pin and sleeve connector, and any combinations thereof.

A strain relief connector assembly for flexible electrical wiring is also provided that includes a connector; a strain relieving device having a first connecting feature; and an adapter having a first side and a second side. The second side has a second connecting feature. The adapter is connected to the connector so as to compress a bushing between the connector and the first side of the adapter. The first connecting feature of the functional device and the second connecting feature of the adapted are connected to one another. In some embodiments, the strain relief connector assembly can further include an arc of bend control device. The flexible electrical wiring can include flexible electric cords or flexible conduits. In embodiments where the electrical wiring is flexible conduit, the flexible conduit can metallic or non-metallic.

A strain relief electrical connector assembly for flexible electrical wiring is also provided. The assembly includes a connector selected from the group consisting of a male or female straight blade connector, a male or female twist lock connector, a pin and sleeve connector, and any combinations thereof; a strain relieving device, a tightening nut, and a first threaded member; and an adapter having a first side and a second side. The second side having a second threaded member. The adapter being connected to the connector so as to compress a bushing between the connector and the first side of the adapter. In some embodiments, the strain relief connector assembly can further include a strain relieving mesh. Here, the first and second threaded members are connected to one another to that the strain relieving mesh extends in a direction opposite the connector. The flexible electrical wiring can include flexible electric cords or flexible conduits. In embodiments where the electrical wiring is flexible conduit, the flexible conduit can metallic or non-metallic.

The above-described and other features and advantages of the present disclosure will be appreciated and understood by those skilled in the art from the following detailed description, drawings, and appended claims.

DETAILED DESCRIPTION

Figure 1:
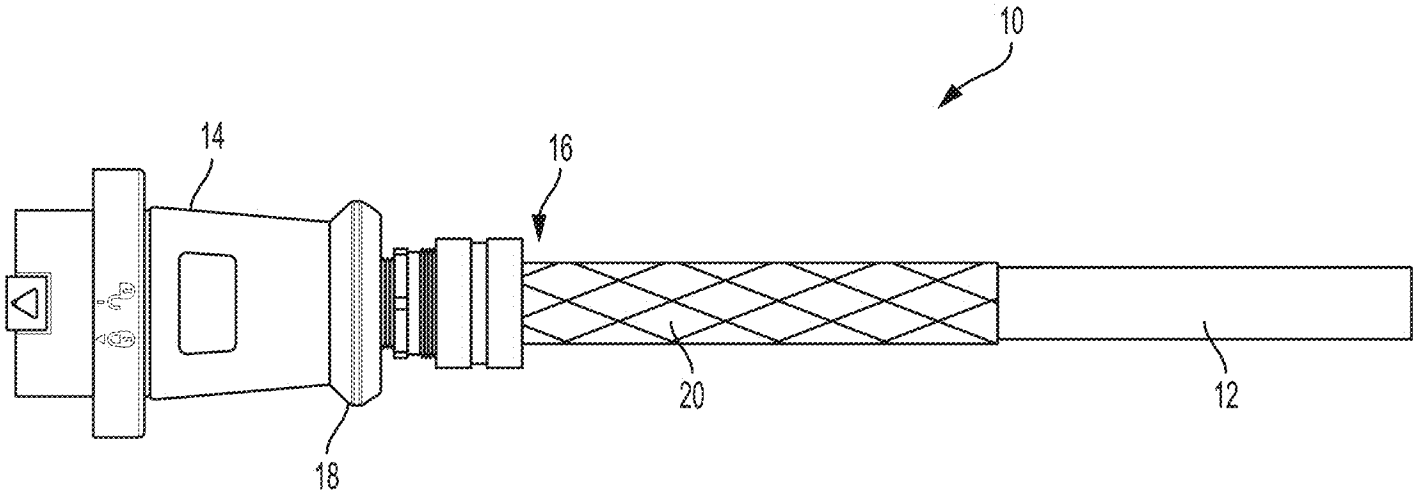
FIG. 1 is a side view of an exemplary embodiment of a strain relief connector assembly for flexible electrical wiring according to the present disclosure.
Figure 2B:
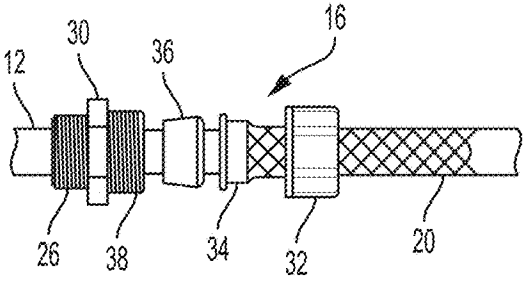
FIG. 2*b* is another partially disassembled view of the assembly of FIG. 1.
Figure 2A:
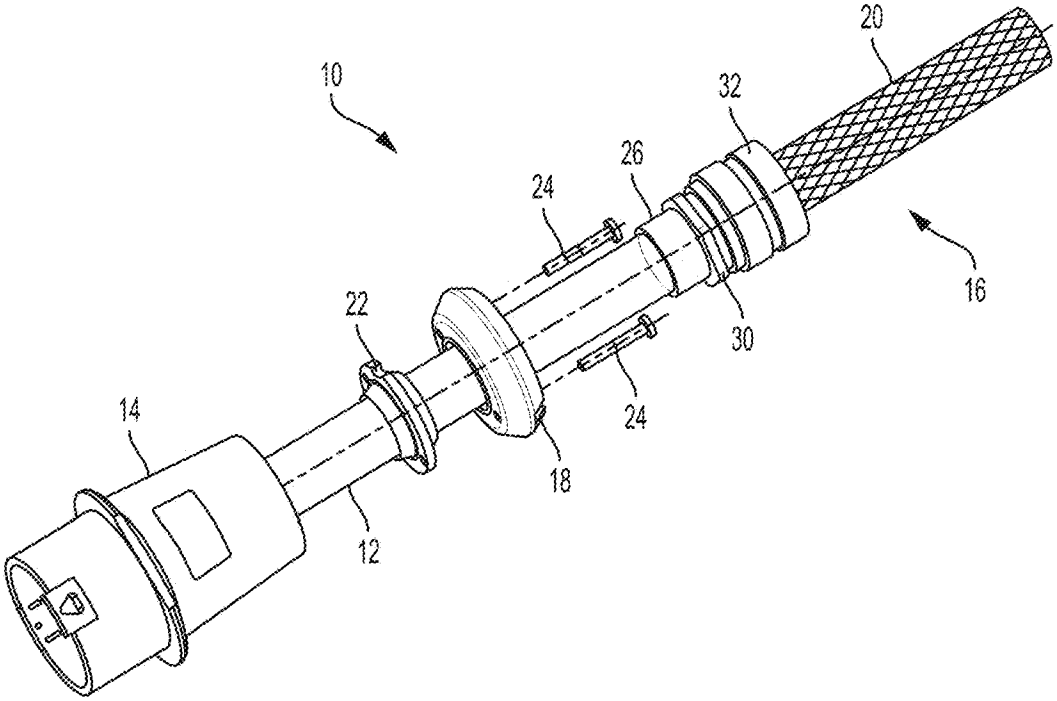
FIG. 2*a* is a partially disassembled view of the assembly of FIG. 1.
Figure 4:
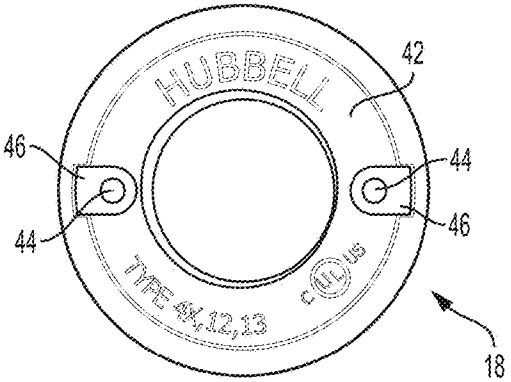
FIG. 4 is a top view of the adapter of FIG. 3.
Figure 6:
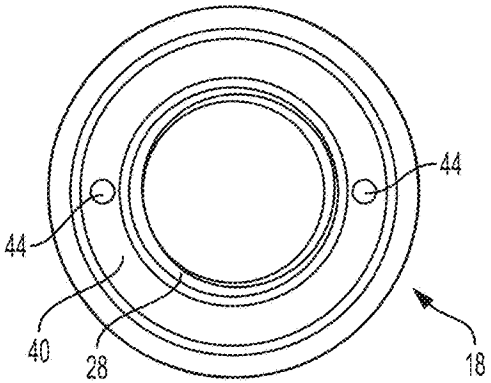
FIG. 6 is a bottom view of the adapter of FIG. 3.

Referring to the drawings and with simultaneous reference to FIGS. 1, 2*a*, and 2*b*, an exemplary embodiment of a strain relief connector assembly according to the present disclosure is shown and is generally referred to by reference numeral 10. Assembly 10 is configured to allow connection between a flexible electrical wiring 12 and a connector 14, while also allowing connection between the wiring and a strain relieving device 16.

Advantageously, assembly 10 includes an adapter 18 that is configured to separate the sealing function necessary between wiring 12 and connector 14 from the strain relieving function provided by device 16 with a simple structure.

For reasons of clarity, wiring 12 is illustrated as flexible electric cord, connector 14 is illustrated as a female power receptacle, and strain relieving device 16 is illustrated as including further a mesh 20, which provides arc of bend control for the cord.

However, it is contemplated by the present disclosure for wiring 12 to be any flexible electrical wiring such as, but not limited, to cords, sheaths, cables, pipes, wires, tubes, flexible conduits (metallic or non-metallic), and others.

Similarly, it is contemplated by the present disclosure for connector 14 to be any utility connector such as, but not limited to, male or female straight blade connectors, male or female twist lock connectors, pin and sleeve connectors, and others.

As shown in FIG. 2*a*, assembly 10 further includes a compressible sealing bushing 22 and one or more tightening members 24 (two shown).

Wiring 12 passes through adapter 18 and sealing bushing 22 and into connector 14, where the wiring can be operatively connected to the connector to supply electricity to the connector. Members 24 secure adapter 18 to connector 14, which compresses sealing bushing 22 between the adapter and connector in a manner sufficient to provide a desired seal against wiring 12. The seal of assembly 10 prevents or at least mitigates the egress of undesired contaminants into connector 14.

Assembly 10 can be configured to differing levels of protection depending the desired use. For example, it is contemplated by the present disclosure for certain implementations of assembly 10 to be configured to provide a level of protection such as those set forth by the National Electrical Manufacturers Association (NEMA) including, but not limited to protection against ingress of one or more of solid foreign objects (e.g., falling dirt), of dripping water, light splashing water, driven water, driven solid foreign objects (e.g., windblown dust), hose directed water, submerged water, and others.

Figure 3:
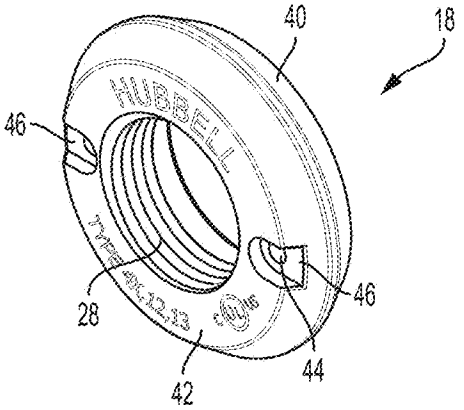
FIG. 3 is a top perspective view of an exemplary embodiment of an adapter according to the present disclosure for use in the assembly of FIG. 1.
Figure 5:
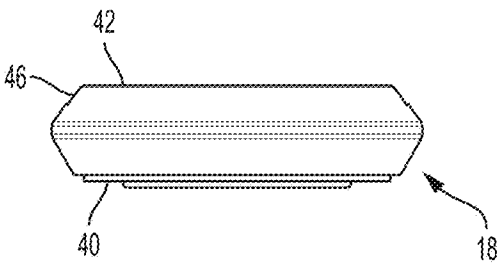
FIG. 5 is a side view of the adapter of FIG. 3.
Figure 8:
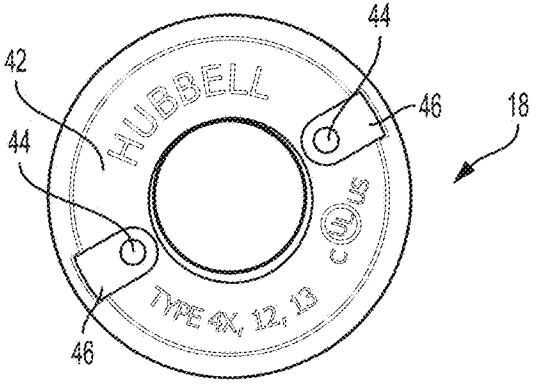
FIG. 8 is a top view of the adapter of FIG. 7.
Figure 10:
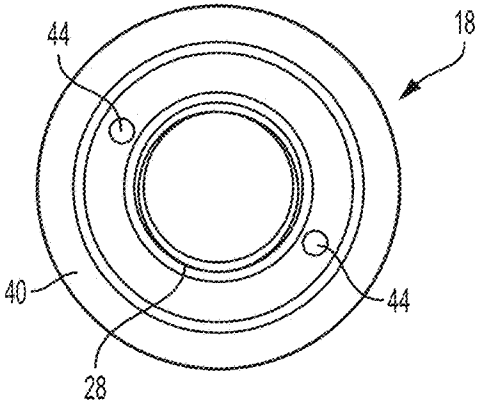
FIG. 10 is a bottom view of the adapter of FIG. 7.
Figure 7:
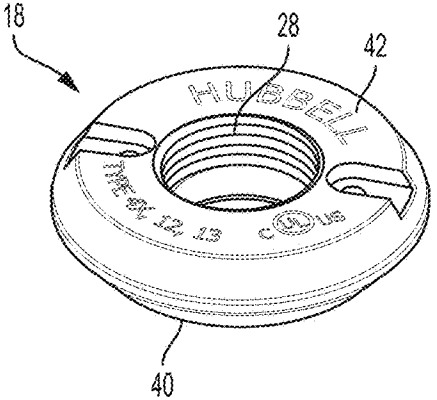
FIG. 7 is a top perspective view of an alternate exemplary embodiment of an adapter according to the present disclosure.
Figure 9:
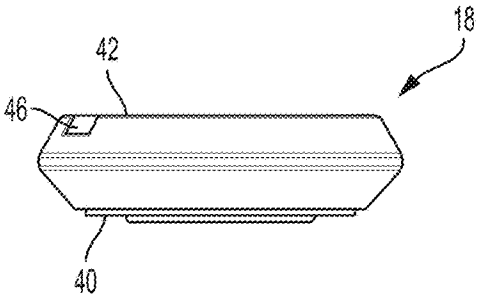
FIG. 9 is a side view of the adapter of FIG. 7.
Figure 12:
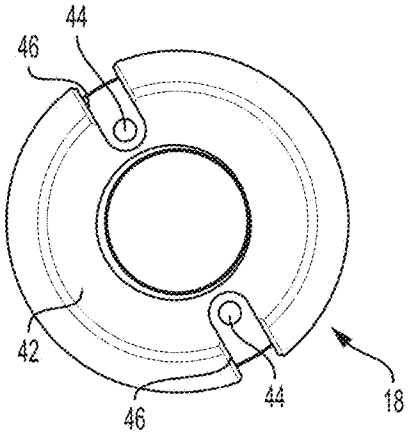
FIG. 12 is a top view of the adapter of FIG. 11.
Figure 14:
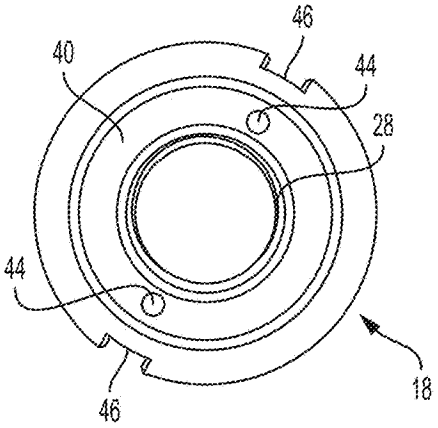
FIG. 14 is a bottom view of the adapter of FIG. 11.
Figure 11:
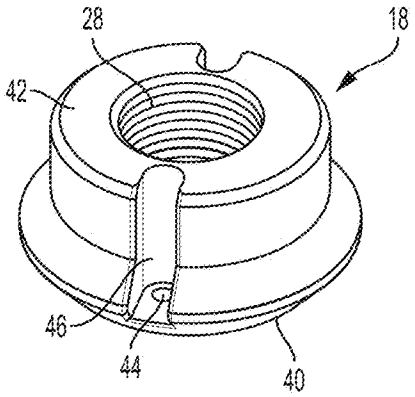
FIG. 11 is a top perspective view of another alternate exemplary embodiment of an adapter according to the present disclosure.
Figure 13:
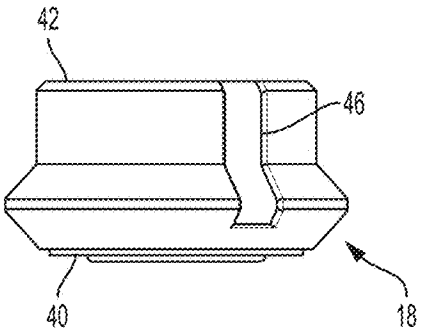
FIG. 13 is a side view of the adapter of FIG. 11.

As shown in FIGS. 2*a*, 2*b*, and 3, strain relieving device 16 includes a first connecting feature 26 and adapter 18 includes a second connecting feature 28, which mates with the first feature. Wiring 12 passes through functional device 16, with first and second connecting features 26, 28 secured to one another.

In the illustrated embodiment, first connecting feature 26 is illustrated as a male thread, while second connecting feature 28 is illustrated as a female thread. Here, strain relieving device 16 can include a first nut 30 that is unitary with first connecting feature 26, so as to facilitate tightening and loosening of the first connecting feature into adapter 18.

Of course, it is contemplated by the present disclosure for assembly 10 to have any desired configuration of first and second connecting features 26, 28 such as, but not limited to, bayonet-and-slot features, interference or press fit features, and others.

Device 16 is configured to prevent pullout of wiring 12 from connector 14. Specifically, device 16 is configured to relieve strain in the assembly to prevent pullout of wiring 12 from connector 14. Thus, strain relieving device 16 further includes a compression nut 32, a collar 34, and a strain bushing 36. Additionally, device 16 further includes a third connecting feature 38 that is, preferably, unitary with first connecting feature 26 and first nut 30 and is illustrated as a male thread. In this manner, collar 34 is threadably engaged on third connecting feature 38 so as to compress bushing 36 onto wiring 12 so as to provide a strain relieving function to assembly 10.

In some embodiments, assembly 10 is configured to meet and/or exceed the industrial standard for attachment plugs and receptacles that cover attachment plugs, receptacles, cord connectors, inlets, current taps provided with wiring terminals for flexible cord, and flatiron and appliance plugs—all intended for connection to a branch circuit for use in accordance with the National Electrical Code, ANSI/NFPA 70, which is published by the Underwriters Laboratory as UL 498.

In embodiments of assembly 10 where arc of curvature control for wiring 12 is desired, strain relieving device 16 includes mesh 20 depending from collar 34.

Adapter 18 is described in more detail with simultaneous reference to FIGS. 3 through 6. Adapter 18 has a first side 40 and a second side 42.

First side 40 is configured to abut and compress bushing 22. Second side 42 includes second connection feature 28, which corresponds to and is connected to first connection feature 26 of strain relieving device 16. In this manner, adapter 18 is configured to form a sealed connection to wiring 12 and connector 14, as well as form a connection with strain relieving device 16.

Adapter 18 includes openings 44 extending between first and second sides 40, 42. Tightening members 24 extend through openings 44 from second side 42 to first side 40 to connect the adapter to connector 14. In some embodiments, second side 42 includes a recess 46 defined around each opening 44, where the recess is sized to receive a tool (not shown) used to tighten or loosen members 24.

Adapter 18 can, depending on type of wiring 12 and/or type of connector 14 and/or type of strain relieving device 16 and/or the type of seal required take many different forms or shapes. One alternate exemplary embodiment of adapter 18 is shown in FIGS. 7 to 10 and another embodiment is shown in FIGS. 11 to 14. Adapter 18 can be formed of any material having sufficient strength to form the connection between first and second connecting features 26, 28. For example, it is contemplated by the present disclosure for adapter 18 to be made of a material selected from the group consisting of steel, aluminum, plastic, and any combinations thereof.

Figure 15:
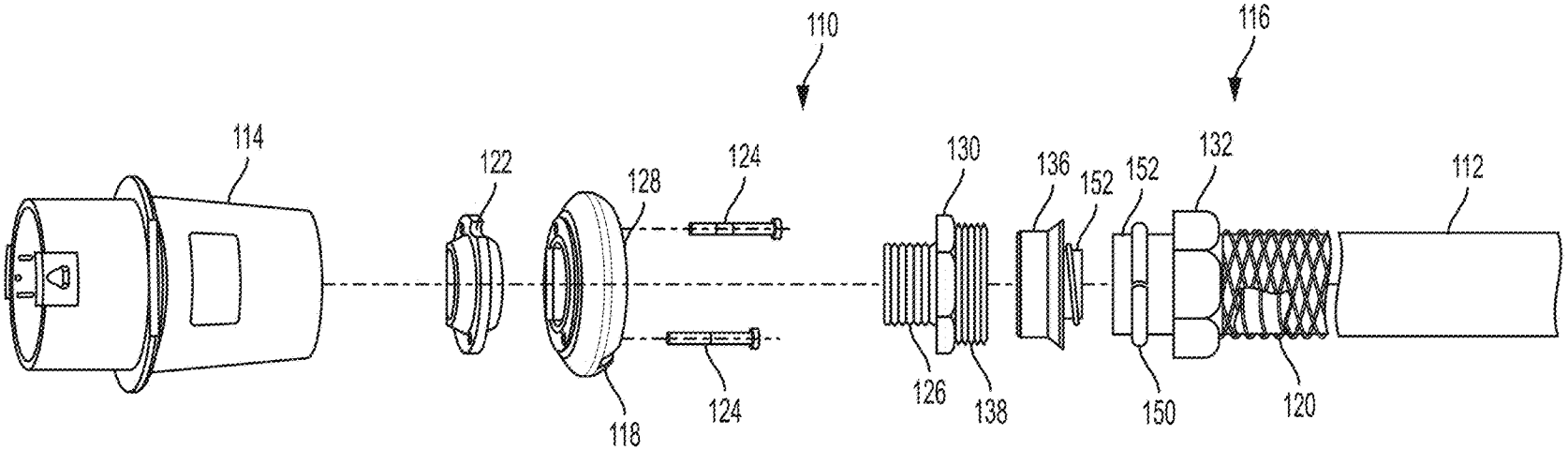
FIG. 15 is a partially disassembled view of another exemplary embodiment of a strain relief connector assembly according to the present disclosure.

Referring now to FIG. 15, an alternate exemplary embodiment of a strain relief connector assembly according to the present disclosure is shown. Here, component parts performing similar or analogous functions are labeled in multiples of 100 and, thus, the assembly is generally referred to by reference numeral 110.

Assembly 110 is configured to allow connection between flexible electrical wiring 112 and connector 114, while also allowing connection between the wiring and strain relieving device 116. Here, wiring 112 is illustrated as flexible conduit having electrical conductors disposed therein (not shown), connector 114 is illustrated as a female power receptacle, and strain relieving device 116 is illustrated as further including mesh 120, which provides arc of bend control for the wiring. In this embodiment where wiring 112 is illustrated as flexible conduit, it is contemplated by the present disclosure for the conduit to metallic or non-metallic.

Assembly 110 includes adapter 118 that is configured to separate the sealing function necessary between wiring 112 and connector 114 from the strain relieving function provided by device 116 with a simple structure.

Assembly 110 includes compressible sealing bushing 122 and one or more tightening members 124 (two shown). Members 124 secure adapter 118 to connector 114, which compresses bushing 122 between the adapter and connector in a manner sufficient to provide a desired seal.

Strain relieving device 116 includes a first connecting feature 126 and adapter 118 includes a second connecting feature 128, which mates with the first feature.

In the illustrated embodiment, first connecting feature 126 is illustrated as a male thread, while second connecting feature 128 is illustrated as a female thread. Here, strain relieving device 116 can include a first nut 130 that is unitary with first connecting feature 126, so as to facilitate tightening and loosening of the first connecting feature into adapter 118.

Of course, it is contemplated by the present disclosure for assembly 110 to have any desired configuration of first and second connecting features 126, 128 such as, but not limited to, bayonet-and-slot features, interference or press fit features, and others.

Device 116 is configured to prevent pullout of wiring 112 from connector 114. Specifically, device 116 is configured to relieve strain in the assembly to prevent pullout of wiring 112 from connector 114. Thus, strain relieving device 116 further includes a compression collar 132, a ferrule 136, and a gland-ring 150. Additionally, device 116 further includes a third connecting feature 138 that is, preferably, unitary with first connecting feature 126 and first nut 130 and is illustrated as a male thread. In this manner, collar 132 is threadably engaged on third connecting feature 138 so as to cause ring 150 to compress wiring 112 onto ferrule 136. In some embodiments, ferrule 136 and wiring 112 can further include corresponding threads (not shown in the conduit) to further provide leak proof connection between the wiring and the ferrule.

In embodiments of assembly 110 where arc of curvature control for wiring 112 is desired, strain relieving device 116 includes mesh 120 depending from compression collar 132.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

| LISTING OF REFERENCE NUMERALS |
|---|
| strain relief connector assembly 10 |
| electrical wiring 12 |
| connector 14 |
| strain relieving device 16 |
| adapter 18 |
| mesh 20 |
| compressible sealing bushing 22 |
| tightening members 24 |

-continued

| LISTING OF REFERENCE NUMERALS |
|---|
| first connecting feature 26 |
| second connecting feature 28 |
| first nut 30 |
| compression nut 32 |
| collar 34 |
| strain bushing 36 |
| third connecting feature 38 |
| first side 40 |
| second side 42 |
| openings 44 |
| recess 46 |
| strain relief connector assembly 110 |
| electrical wiring 112 |
| connector 114 |
| strain relieving device 116 |
| adapter 118 |
| mesh 120 |
| compressible sealing bushing 122 |
| tightening members 124 |
| first connecting feature 126 |
| second connecting feature 128 |
| first nut 130 |
| compression collar 132 |
| ferrule 136 |
| third connecting feature 138 |
| gland-ring 150 |

What is claimed is:

1. A strain relief connector assembly for flexible wiring, comprising:

a connector;

a plurality of tightening members;

a sealing bushing;

an adapter having a first side, a second side, and a first thread;

a nut having a second thread and a third thread depending therefrom;

a strain bushing; and a compression nut connectable to the flexible wiring, the compression nut having a fourth thread, wherein the adapter and the connector are connected to one another by the plurality of tightening members so that a seal is defined by a first side of the adapter compressing the sealing bushing against the connector, wherein the adapter and the nut are connected to one another by engagement of the first and second threads, and wherein the nut and the compression nut are connected to one another by engagement of the third and fourth threads with the strain bushing between the nut and the compression nut so that the strain bushing forms a strain relieving connection with the flexible wiring.

2. The strain relief connector assembly of claim 1, further comprising a collar positioned between the nut and the compression nut.

3. The strain relief connector assembly of claim 2, further comprising mesh depending from the collar, the mesh being configured to provide arc of bend control to the flexible wiring.

4. The strain relief connector assembly of claim 1, wherein the connector is selected from the group consisting of a male or female straight blade connector, a male or female twist lock connector, a pin and sleeve connector, and any combinations thereof.

5. The strain relief connector assembly of claim 1, wherein the flexible wiring is selected from the group consisting of cords, sheaths, cables, pipes, wires, tubes, and flexible conduits.

6. A strain relief connector assembly for flexible wiring, comprising:

a connector;

a strain relieving device having a nut with unitary first and second male threads depending therefrom, a strain bushing, and a compression nut; and an adapter having a first side and a second side, the second side having a female thread, wherein the adapter is connected to the connector so as to compress a sealing bushing between the connector and the first side, wherein the first male thread and the female thread are connected to one another, and wherein the second male thread is connected to the compression nut so as to compress the strain bushing between the compression nut and the second side of the adapter.

7. The strain relief connector assembly of claim 6, further comprising a collar positioned between the compression nut and the strain bushing.

8. The strain relief connector assembly of claim 7, further comprising mesh depending from the collar, the mesh being configured to provide arc of bend control to the flexible wiring.

9. The strain relief connector assembly of claim 6, wherein the connector is selected from the group consisting of a male or female straight blade connector, a male or female twist lock connector, a pin and sleeve connector, and any combinations thereof.

10. The strain relief connector assembly of claim 6, wherein the adapter is configured to separate a sealing function from a strain relieving function, the sealing function being defined by the adapter being connected to the connector so as to compress the sealing bushing between the connector and the first side, and the strain relieving function being defined by the first male thread of the strain relieving device and the female thread of the adapter being connected to one another.

11. The strain relief connector assembly of claim 6, wherein the flexible wiring is selected from the group consisting of cords, sheaths, cables, pipes, wires, tubes, and flexible conduits.

12. A strain relief connector assembly for flexible wiring, comprising:

a connector;

a strain relieving device having a first threaded member;

a plurality of tightening members; and an adapter having a first side and a second side, the second side having a second threaded member, the plurality of tightening members extending through a corresponding plurality of openings in the adapter from the second side to the first side to connect the adapter to the connector so as to compress a bushing between the connector and the first side of the adapter, the first and second threaded members being connected to one another.

13. The strain relief connector assembly of claim 12, further comprising mesh depending from the strain relieving device, the mesh being configured to provide arc of bend control to the flexible wiring.

14. The strain relief connector assembly of claim 12, wherein the first threaded member is a male threaded member and the second threaded member is a female threaded member.

15. The strain relief connector assembly of claim 12, wherein the first threaded member is a female threaded member and the second threaded member is a male threaded member.

* * * * *